US005821000A

United States Patent [19]

Inui et al.

[11] Patent Number: 5,821,000

[45] Date of Patent: Oct. 13, 1998

[54] COMPOSITE MAGNETIC MEMBER AND PROCESS FOR PRODUCING THE MEMBER

[75] Inventors: Tsutomu Inui, Yanago; Jun Sunakawa, Yasugi; Masaki Shimizu, Nagoya; Keizo Takeuchi, Handa; Shinya Sugiura, Kariya, all of Japan

[73] Assignee: Hitachi Metals, Ltd. and Denso Corporation, Japan

[21] Appl. No.: 759,687

[22] Filed: Dec. 6, 1996

[30] Foreign Application Priority Data

Dec. 7, 1995 [JP] Japan ..... 7-318887

[51] Int. Cl.[6] ..... H01F 1/00

[52] U.S. Cl. ..... 428/611; 428/692; 428/610; 428/928; 148/312; 148/902; 148/121; 148/122; 148/307; 148/309; 148/310; 148/319

[58] Field of Search ..... 428/611, 692, 428/610, 928; 148/312, 902, 121, 122, 307, 309, 310, 319

[56] References Cited

U.S. PATENT DOCUMENTS

| | | | |
|---|---|---|---|
| 2,590,074 | 3/1952 | Bloom | 148/1 |
| 3,581,054 | 5/1971 | Bjorkroth | 219/146 |
| 3,650,709 | 3/1972 | Morsing | 29/196.1 |
| 3,960,617 | 6/1976 | Levin et al. | 148/121 |
| 3,971,676 | 7/1976 | Detert et al. | 148/121 |
| 4,609,577 | 9/1986 | Long | 428/683 |

FOREIGN PATENT DOCUMENTS

| | | | |
|---|---|---|---|
| 629 711 | 12/1994 | European Pat. Off. | C21D 8/12 |
| 6-74124 | 3/1994 | Japan | F02M 51/06 |
| 6-140216 | 5/1994 | Japan | H01F 1/00 |
| 7-11397 | 1/1995 | Japan | C22C 38/00 |

OTHER PUBLICATIONS

ARA, et al., *Formation of Magnetic Grating on Steel Plates By Electron/Laser Beam Irradiation*, IEEE Transactions on Magnetics, vol. 25, No. 5, Sep. 1989, pp. 3830–3832.

Richard M. Bozorth, *Ferromagnetism,* NY, 1951, pp. 146–153.

*Primary Examiner*—M. Nuzzolillo
*Assistant Examiner*—Steven H. VerSteeg
*Attorney, Agent, or Firm*—Cushman Darby & Cushman Intellectual Property Group of Pillsbury Madison & Sutro, LLP

[57] ABSTRACT

A composite magnetic member formed of a single material having a ferromagnetic section with high soft magnetism and a non-magnetic or the like section with sufficiently low magnetic (feebly magnetized or non-magnetic) and sufficient low MS temperature and a process for producing the member are provided. A composite magnetic member made of a single material of martensitic stainless steel including Ni having two sections of a ferromagnetic section having maximum permeability not less than 200 and coercive force not more than 2000 A/m and a feebly magnetized section having permeability not more than 2 and MS temperature not more than −30° C. A process for producing a composite magnetic member, comprising the steps of locally heating a single material of martensitic stainless steel having particular composition including Ni and having ferrite and carbide, at temperature of more than austenite transformation temperature, and rapidly quenching it so that austenite structure is formed in the heated and quenched section which structure has MS temperature not more than −30° C.

1 Claim, No Drawings

COMPOSITE MAGNETIC MEMBER AND PROCESS FOR PRODUCING THE MEMBER

BACKGROUND OF THE INVENTION

1. Field of the Invention

The present invention relates to a composite magnetic member having a ferromagnetic section and a non-magnetic or feebly magnetized (both of which are referred to as "feebly magnetized") section suitable for an actuator (herein referred to as an "oil controlling device") or the like which deals with automobile fuel or hydraulic operating fluid and relates to a process for producing the member.

2. Description of the Related Art

An actuator used for an automobile oil controlling device partially has a structure where a feebly magnetized section is formed in a part of a stator ferromagnetic (generally soft magnetic) so that magnetic flux flows to a movable core, thereby effectively utilizing the magnetic flux.

To form the feebly magnetized section in a part of the ferromagnetic parts, ferromagnetic parts and feebly magnetized parts are conventionally joined by some methods such as soldering or laser welding.

In contrast to these methods for joining different material, a method in which a single material is used to form the ferromagnetic section by cold working and the feebly magnetized section by a heat treatment is recently proposed.

Japanese Unexamined Patent Publication No. 6-140216 suggests a method that overall metastable austenitic stainless steel member is feebly magnetized by a solution treatment at high temperature and a part of the member is processed at a temperature between an Md temperature and an MS temperature, to produce a strain-induced martensite transformation, thereby forming the ferromagnetic part.

Japanese Unexamined Patent Publication No. 6-74124 discloses a stator of a fuel injector in which the stator member is produced by a method comprising the steps of performing an intensive working in order to change austenite to martensite so that a ferromagnetization is achieved, and subjecting a part of ferromagnetic material to heating treatment to obtain austenite so that a feebly magnetized section may be obtained. In this publication, there is disclosed a method in which an austenite-generating element is melted and added in a section of the ferromagnetic member so that the section is feebly magnetized, and another method in which a ferrite-generating element is melted and added into a section of an austenitic alloy so that the section becomes ferromagnetic section.

Melting and adding austenite-generating elements, ferrite-generating elements and the like to a specific section of base material is generally not easily achieved. The present inventors experimented and studied extensively a member having a feebly magnetized or the like section in a part of ferromagnetic material and a process for producing the member.

As a result, such ferromagnetic section obtained by generating martensite through the cold working of the metastable austenite as proposed above had about 160 in maximum permeability ($\mu$m) and about 2500 A/m in coercive force (Ec), even though annealing for removing strain is applied after working, thereby no excellent soft magnetic property was obtained.

Automobile parts are, in some cases, exposed at low temperature of reaching −30°. In a case where a feebly magnetized section is exposed to the low temperature reaching −30° C., martensite transformation occurs by exposing at such low temperature and the section is then ferromagnetic, with the result that the automobile parts can not be applied to a practical use. In other words, in a case of ferromagnetizing by the cold working as mentioned above, if such a composition is used as the maximum permeability of the ferromagnetic section is made high (the metastable austenite is made more unstable), the MS temperature (temperature of starting a transformation from non-magnetic austenite to ferromagnetic martensite) of the feebly magnetized section becomes not less than −30° C., thereby the parts can not be applicable to a practical use. Consequently, it is found difficult to provide in a single material both a soft magnetism section with high permeability as well as small coercive force and a feebly magnetized section having not less than −30° C. of the MS temperature.

As a manufacturing method of metal parts having a magnetic section and a feebly magnetized or the like section, Japanese Unexamined Patent Publication No. 50-3017 already discloses a manufacturing method of "manufactured goods having an integral structure made of metal capable of obtaining a magnetic structure during an aging step and losing the structure after a tempering at high temperature."

However, the No. 50-3017 discloses no specific application. C—(Co, Ni)—(Cr,V)—Fe type magnet alloy, 0.37C-0.6Si-0.4Mn-17Cr-6.2Ni-0.5Ti—Fe (numerals represent % by weight) stainless steel or the like is disclosed as an example of the alloy in Detailed Description of the Invention. However, no quantitative magnetic value of the soft magnetism section and especially no MS temperature of the soft magnetism section in the stainless steel is disclosed. Further, machinability is experimented by use of a material prepared by forging an ingot, and formability thereof is unknown.

The present invention relates to a single material having a ferromagnetic section showing an excellent soft magnetism with sufficient high maximum permeability $\mu$m and sufficient low coercive force Hc and having a feebly magnetized section with MS temperature not more than −30° C. and a fabrication method thereof.

The present inventors formerly proposed a method in which a single material is used instead of a conventional method in which a plurality of parts of ferromagnetic (soft magnetic) material and feebly magnetized material are joined by a soldering or a welding, with respect to a magnetic circuit of an automobile actuator, in Japanese Unexamined Patent Publication No. 6-140216 and Japanese Unexamined Patent Publication No. 7-11397. However, in this case, the ferromagnetism is obtained by a strain induced martensite transformation, therefore soft magnetism of about 160 in maximum permeability $\mu$m and about 2500 A/m in coercive force Hc are insufficient, thereby application thereof is limited.

The present inventors have discovered through tests that high soft magnetism of about 600 in maximum permeability $\mu$m and about 880 A/m in coercive force Hc is obtained by a structure of ferrite and carbide which structure can be obtained by annealing martensitic stainless steel made of Fe alloy including Cr and C at low temperature, and that feeble magnetism having permeability $\mu<2$ is obtained by heating a part thereof at a temperature not less than 1100° C. and then by rapidly quenching, but the stainless steel is not applicable to a practical use for an automobile because the MS temperature of this section is −10° C. The present invention is achieved through further researches regarding how MS temperature is lowered while keeping the above magnetic property.

SUMMARY OF THE INVENTION

An object of the present invention is to provide a composite magnetic member formed of a single material having a ferromagnetic section of high soft magnetism and a feebly magnetized section having both sufficiently feeble magnetism and a sufficiently low MS temperature not more than −30° C., and to provide a process for producing the member.

The present inventors have discovered that, in a ferromagnetic section, soft magnetism is remarkably enhanced by ferrite structure instead of conventional martensite strain-induced from metastable austenite and that an MS temperature of a feebly magnetized section formed by heating a part of the ferromagnetic section at high temperature and then by rapidly quenching is sufficiently lowered in a case where a proper amount of Ni had been previously added to a base material, whereby the present invention is achieved.

In other words, the composite magnetic member of the present invention is made of single material of martensitic stainless steel including Ni. The single material is provided with two sections. The two sections are a ferromagnetic section and a feebly magnetized section. The ferromagnetic section has maximum permeability not less than 200 and coercive force not more than 2000 A/m. The feebly magnetized section has permeability not more than 2 of and an MS temperature not more than −30° C. The martensitic stainless steel according to the present invention preferably consists, by mass percent, of 0.35 to 0.75% C, 10.0 to 14.0% Cr, 0.5 to 4.0% Ni, 0.01 to 0.05% N, at least one not more than 2.0% in total selected from the group consisting of Si, Mn and Al as deoxidizer, and the balance Fe and incidental impurities, or preferably consists, by mass percent, of 0.5 to 4.0% Ni, 13.0 to 25.0% of Ni equivalent (%Ni+30*%C+0.5*%Mn+30*%N), 10.1 to 15.0% of Cr equivalent (%Cr+%Mo+1.5*%Si+1.5%Nb), the balance Fe and incidental impurities.

A method for producing the composite magnetic member of the present invention, comprises the steps of preparing a single material of martensitic stainless steel having ferromagnetic structure containing ferrite and carbides which steel contains, by mass percent, 0.35 to 0.75% C, 10.0 to 14.0% Cr, 0.5 to 4.0% Ni, 0.01 to 0.05% N, at least one not more than 2.0% in total selected from the group consisting of Si, Mn and Al as deoxidizer, or which steel contains, by mass percent, 0.5 to 4.0% Ni, 13.0 to 25.0% Ni equivalent (%Ni+30*%C+0.5*%Mn+30*%N) and 10.1 to 15.0% Cr equivalent (%Cr+%Mo+1.5*%Si+1.5%Nb), heating a part of the single material at temperature not less than austenite transformation temperature, and then rapidly quenching the locally heated part so that this part may keep austenite structure and so that this part may have MS temperature not more than −30° C. which MS temperature is defined by a temperature at which transformation from non-magnetic austenite to ferromagnetic martensite begins.

The present invention is based on such discovery as, by cooling a ferromagnetic martensitic stainless steel, which had been previously subjected to annealing to become like ferrite structure to thereby have sufficient soft magnetism, after heating a part of the ferromagnetic stainless steel up to a particular temperature, the structure of the local part can be changed into a retained austenite having both sufficiently feeble magnetism and sufficiently low MS temperature.

The martensitic stainless steel member as material of the present invention is preferably annealed to obtain sufficiently high ferromagnetism in a case where the member is subjected to a cold working or a hot working. Proper annealing temperature is from 600 to 850° C., preferably from 650° to 800° C. Cooling after the annealing is preferably gradual cooling.

Local heating temperature of the particular section is preferably such a high temperature as 1000° C. to 1200° C. so as to sufficiently lower the MS temperature of the retained austenite and heating of a short period of time is preferred in view of local heating. To obtain austenite with a low MS temperature, rapid quenching is preferred after the heating and a thin or narrow shaped member is preferred. The heating method for limiting the heated section is preferably performed by use of heating means having high energy density such as induction heating, a laser, an electron beam or the like.

Reasons of numerical limitation in the present invention is explained below.

The member of the present invention is formed of a ferromagnetic section and a feebly magnetized section.

The maximum permeability $\mu$m is not less than 200 and the coercive force Hc is not more than 2000 A/m in the ferromagnetic section, and the MS temperature is not more than −30 in the feebly magnetized section. This is because the ranges are easily obtained by the present invention and are a required properties for a member of an oil control device or the like the obtaining of which member is an object of the present invention. Such properties have never obtained in the prior art aforementioned.

The permeability is not more than 2 in the feebly magnetized section of the present invention. This is because the feebly magnetized section having more than 2 of permeability is not proper for the use of feebly magnetized section.

According to the present invention, it is easy and preferable that the ferromagnetic section has maximum permeability not less than 250$\mu$ max and coercive force Hc not more than 1000 A/m, and the feebly magnetized section has permeability $\mu$ not more than 1.5, more preferably not more than 1.2.

Preferable composition of the present invention is explained below.

Carbon (C) is an important element for the present invention to enhance mechanical strength of the member and to stabilize non-magnetic austenite. A preferred range of C content is from 0.35 to 0.75%. If the C content is less than 0.35%, the stability of the austenite will be deteriorated and the MS temperature in the feebly magnetized section will be more than −30° C. which feebly magnetized section is made to have magnetic permeability not more than 2$\mu$ by rapid quenching from the high temperature. Therefore, the C content is preferably not less than 0.35%. If the C content exceeds 0.75%, workability during the cold working will be deteriorated. More preferable range of the C content is from 0.45 to 0.65%.

Cr is an element for effectively improving corrosion resistance as well as the mechanical strength of the member of the present invention. A preferred range of Cr content is from 10.0 to 14.0%. If the Cr content is less than 10.0%, the corrosion resistance will become inferior as the stainless steel. If the Cr content exceeds 14.0%, ferrite will be stable with the result that it becomes difficult to obtain feeble magnetism when quenched from high temperature. More preferable range of the Cr content is from 12.0 to 14.0%.

Ni is an important element to lower the MS temperature of the feebly magnetized section effectively. A preferred range of Ni content is from 0.5 to 4.0%. If the Ni content is less than 0.5%, the MS temperature of the feebly magnetized section will exceed −30° C. If the Ni content exceeds 4.0%, proof stress of the annealing material will exceed 60 kgf/$mm^2$, so that working will become difficult. In addition, even if annealed, the coercive force Hc is ≧2000 A/m, so that excellent soft magnetism is hard to be obtained. More preferable range of the Ni content is not less than 1%.

N has an effectiveness similar to Ni content as an austenite-generating element. In addition, N has an advantage of low-priced. A preferred range of N content is from 0.01 to 0.05%. If the N content is less than 0.01%, the MS temperature of the feebly magnetized section will not be sufficiently lowered, and expensive material such as Ni will have to be used. If the N content is not less than 0.05%, a treatment for decreasing N content will become necessary during melting, and proof stress will become great and a work hardening degree will become high, so that workability is deteriorated. More preferable range of the N content is from 0.015 to 0.040%.

The member of the present invention may include at least one deoxidizer not more than 2.0% in total selected from the group consisting of Si, Mn and Al, in addition to the aforementioned C, Cr, Ni and N.

W, Mo, Nb, Ti, and/or Cu etc. may be added to the member of the present invention to improve particular properties such as corrosion resistance, mechanical strength or the like.

The preferred composition range of the martensitic stainless steel of the member according to the present invention may be defined by Ni equivalent and Cr equivalent.

The Ni equivalent is defined by (%Ni+30*%C+0.5*%Mn+30*%N) and the Cr equivalent is defined by (%Cr+%Mo+1.5*%Si+1.5%Nb). A preferred range of the Ni equivalent is from 13.0 to 25.0%. If the Ni equivalent is less than 13.0%, the MS temperature of the feebly magnetized section having $\mu \leqq 2$ will hardly become not more than −30° C. when rapidly quenched from high temperature. If the Ni equivalent exceeds 25.0%, the soft magnetism of the ferromagnetic section will be deteriorated when annealed, thereby $\mu m \geqq 200$ is hardly obtained. A preferred range of the Cr equivalent is from 10.1 to 15.0%. If the Cr equivalent is less than 10.1%, the corrosion resistance will be deteriorated. If the Cr equivalent exceeds 15%, it will be necessary to add more amount of austenite-generating elements of Ni, C and N to keep permeability not more than 2 obtained by rapid quenching from high temperature, and the soft magnetism of the ferromagnetic section will be deteriorated, and working will become difficult. Therefore, an upper limit thereof is 15%. More preferable range of the Ni equivalent and the Cr equivalent are from 15.0 to 23.5 and from 12.1 to 14.5%, respectively. Most preferred range of the Cr equivalent is from 13.0 to 14.5%.

DESCRIPTION OF THE PREFERRED EMBODIMENTS

A ferromagnetic section and a feebly magnetized section were formed on separate test pieces or sequentially without coexistence of these sections in a single member. However, the test was intended to be the pseudo coexistence of the ferromagnetic section and the feebly magnetized section because the cooling of the test piece after heating is performed by oil-cooling after the intervention of air cooling.

EXAMPLE 1

In a case where a martensitic stainless steel was annealed at 600° to 850° C. after cold rolling, soft magnetism property of about $\mu m$=600 and about Hc=800 A/m was obtained. However, the permeability of the annealed material was $\mu$=1.3 when quenched from high temperature, which $\mu$ was a slightly high as that of the feebly magnetized material for electronics. In addition, the MS temperature was higher than −30° C., therefore, the material was not applied to a practical use for automobiles.

The present inventors studied an effect of Ni for purpose of lowering the MS temperature of an alloy having non-magnetic retained austenite structure produced by rapid quenching from high temperature, and for the purpose of obtaining high maximum permeability achieved in to a structure containing ferrite and carbides which structure was obtained by annealing.

An ingot of 10 kg in which a Ni content was varied by a vacuum melting was subjected to a forging and a hot rolling to thereby prepare a plate having 3.5 mm in thickness. The plate was annealed at a temperature from 600° to 850° C. depending upon a composition thereof. An oxide layer section formed on a surface of the plate was removed. The plate was then subjected to a cold rolling to thereby become 1.5 mm in thickness, and then was subjected to experiments. Table 1 shows alloy compositions of the example members of the present invention and comparative example members.

TABLE 1

(% by mass)

| No. | C | Si | Mn | Ni | Cr | N | Fe | Nieq | Creq | Remarks |
|---|---|---|---|---|---|---|---|---|---|---|
| 1 | 0.60 | 0.21 | 0.53 | 0.02 | 13.52 | 0.02 | rest | 18.88 | 13.83 | comparative member |
| 2 | 0.60 | 0.21 | 0.50 | 2.01 | 13.72 | 0.02 | " | 20.86 | 14.03 | member of the present invention |
| 3 | 0.62 | 0.22 | 0.50 | 3.96 | 13.55 | 0.03 | " | 23.71 | 13.88 | member of the present invention |
| 4 | 0.64 | 0.21 | 0.55 | 4.87 | 13.47 | 0.03 | " | 25.24 | 13.78 | comparative member |
| 5 | 0.65 | 0.20 | 0.51 | 5.79 | 13.52 | 0.03 | " | 25.51 | 13.82 | member of the present invention |

Test pieces of magnetic rings having 33 mm in inner diameter and 45 mm in outer diameter and of boards 15 mm square were prepared from cold rolled material. Each lot was annealed at a temperature not more than A1 point. Magnetic properties of the rings were measured. In this case, maximum permeability $\mu m$, coercive force Hc A/m and magnetic flux density B4000 [T] (magnetic flux density at magnetization intensity of H=4000 A/m) were measured. The board of 15 mm square having been annealed, was kept for 5 seconds in a heating furnace in which 1200° C. is maintained, then was air-cooled for 1 second, and oil-cooled as a solution treatment. Permeability (measured with a permeameter) and an MS temperature (measured with a differential scanning calorimeter) of the board were measured. Table 2 shows magnetic properties of ferromagnetic pieces annealed and magnetic properties of feebly magnetized pieces after the solution treatment.

TABLE 2

| | annealed material | | | solution treatment applied material | | |
|---|---|---|---|---|---|---|
| | Hc | | | | | |
| No. | μm | A/m | B4000[T] | μ | Ms(°C.) | Remark |
| 1 | 645 | 800 | 1.31 | 1.52 | −25 | comparative member |
| 2 | 660 | 880 | 1.32 | 1.02 | −41 | member of the present invention |
| 3 | 260 | 1520 | 1.02 | 1.01 | −58 | member of the present invention |

TABLE 2-continued

| | annealed material | | | solution treatment applied material | | |
|---|---|---|---|---|---|---|
| | Hc | | | | | |
| No. | μm | A/m | B4000[T] | μ | Ms(°C.) | Remark |
| 4 | 180 | 1920 | 0.81 | 1.01 | −62 | comparative member |
| 5 | 125 | 2080 | 0.62 | 1.01 | −75 | comparative member |

As apparent from Table 2, as Ni content increases, μm and B4000 of the ferromagnetic piece (annealed material) were lowered and Hc thereof was increased, that is, the soft magnetism was deteriorated, while the MS temperature of the feebly magnetized piece (solution treatment-applied material) was effectively lowered with a decrease of μ.

In metallography, in a case where Ni content exceeds about 4%, in the annealed material a bainite was recognized to coexist, so that the soft magnetism of the ferromagnetic section was deteriorated as described above.

On the other hand, as Ni amount increases, austenite becomes stable and the MS temperature of the feebly magnetized piece was effectively lowered. As shown in Table 2, an amount of the Ni was preferably about not more than 4% which Ni amount brings about such soft magnetism of μm≧200 and Hc≦1600 A/m.

EXAMPLE 2

Alloys shown in Table 3 were melted to generally research the effects of C, Ni, Cr, N, Mo and Nb, and test pieces were produced therefrom in the same steps as disclosed in Example 1, and properties thereof were studied. Results were shown in Table 4. As apparent from Table 4, in a case where the Ni content exceeds 4%, the maximum permeability of the annealed material was lowered showing no excellent soft magnetism.

In a case where a C content was low and a Cr content was high as disclosed in alloy No. 109, μ was relatively high and it was impossible to obtain MS temperature not more than −30° C., even though the solution treatment was applied.

TABLE 3

(% by mass)

| No. | C | Si | Mn | Ni | Cr | Al | N | other | Fe | Nieq | Creq | Remark |
|---|---|---|---|---|---|---|---|---|---|---|---|---|
| 101 | 0.52 | 0.35 | 0.72 | 0.71 | 13.82 | 0.02 | 0.03 | — | rest | 17.57 | 14.34 | member of the present invention |
| 102 | 0.67 | 0.50 | 1.20 | 1.82 | 12.90 | 0.03 | 0.03 | — | " | 23.42 | 13.65 | member of the present invention |
| 103 | 0.41 | 0.25 | 0.63 | 2.07 | 13.53 | 0.03 | 0.02 | — | " | 15.28 | 13.90 | member of the present invention |
| 104 | 0.47 | 0.55 | 1.35 | 2.65 | 13.52 | 0.03 | 0.03 | — | " | 18.32 | 14.34 | member of the present invention |
| 105 | 0.48 | 0.33 | 0.49 | 3.91 | 10.73 | 0.04 | 0.02 | — | " | 19.15 | 11.22 | member of the present invention |
| 106 | 0.49 | 0.24 | 0.50 | 1.55 | 13.51 | 0.15 | 0.03 | Mo 0.62 | " | 17.40 | 14.62 | member of the present invention |
| 107 | 0.51 | 0.25 | 0.53 | 2.05 | 13.79 | 0.03 | 0.03 | Nb 0.58 | " | 18.51 | 15.00 | member of the present invention |
| 108 | 0.52 | 0.32 | 0.77 | 4.79 | 13.78 | 0.05 | 0.04 | — | " | 21.97 | 14.26 | comparative member |
| 109 | 0.34 | 0.33 | 0.85 | 0.55 | 15.23 | 0.04 | 0.03 | — | " | 12.07 | 15.72 | comparative member |

TABLE 4

| | annealed material | | | solution treatment applied material | | |
|---|---|---|---|---|---|---|
| | Hc | | | | | |
| No. | μm | A/m | B4000[T] | μ | Ms(°C.) | Remark |
| 101 | 650 | 800 | 1.33 | 1.15 | −42 | member of the present invention |
| 102 | 570 | 1040 | 1.26 | 1.03 | −48 | member of the present invention |
| 103 | 630 | 880 | 1.29 | 1.22 | −33 | member of the present invention |
| 104 | 420 | 1120 | 1.21 | 1.01 | −51 | member of the present invention |
| 105 | 220 | 1360 | 1.09 | 1.01 | −53 | member of the present invention |
| 106 | 410 | 1520 | 1.10 | 1.02 | −44 | member of the present invention |
| 107 | 400 | 1600 | 1.00 | 1.02 | −47 | member of the present invention |
| 108 | 170 | 1760 | 0.91 | 1.01 | −61 | comparative member |
| 109 | 660 | 800 | 1.33 | 1.39 | −26 | invention |

As described above, according to the present invention, a ferromagnetic section and a feebly magnetized section can be formed in a single material, that is, in one kind of material, in order to produce a part of oil controlling device used in an automobile which part needs to have a ferromagnetic section and a feebly magnetized section because of the structure of magnetic circuits. The ferromagnetic section in the invention has higher soft magnetism than conventional ones obtained from metastable austenite materials. The feebly magnetized section in the invention has low permeability and especially low MS temperature.

That is, in comparison with a prior art mechanism in which a metastable austenite material is cold-worked to be transformed into martensite to thereby obtain a ferromagnetic section a part of which is then changed to a feebly magnetized section by a heat treatment, the ferromagnetic section in the present invention has a structure containing ferrite and carbides strain with less strain, with the result that the permeability of the ferromagnetic section becomes high in the invention. In addition, in the invention a particular amount of Ni is previously added thereto, thereby lowering $\mu$ and especially the MS temperature in the feebly magnetized section. Such ferromagnetic section and feebly magnetized section formed of a single material in the invention can be applicable to an actuator the use of which had been limited in the case of the prior arts. Thereby, effects such as reducing manufacturing costs, improving its performance and extending its application can be obtained.

What is claimed is:

1. A composite magnetic member formed of a single material, said member being made of a martensitic stainless steel containing nickel, said member comprising two portions, a first portion thereof being a ferromagnetic section and a second portion thereof being a magnetized section, said ferromagnetic section having a maximum permeability not less than 200 and a coercive force not more than 2000 A/m, said magnetized section having a permeability not more than 2 and MS temperature of not more than −30° C. which MS temperature is defined by a temperature at which a non-magnetic austenite begins to change into ferromagnetic martensite, wherein said martensitic stainless steel contains, by mass percent, 0.5 to 4.0% nickel, a nickel equivalent, of 13.0 to 25.0% which Nieq is defined by an equation of Nieq=%Ni+30*%C+0.5*%Mn+30*%N, and a chromium equivalent, of 10.1 to 15.0% which Creq is defined by an equation of Creq=%Cr+%Mo+1.5*%Si+1.5*%Nb.

* * * * *